US008552932B2

(12) United States Patent
Sohn et al.

(10) Patent No.: US 8,552,932 B2
(45) **Date of Patent: *Oct. 8, 2013**

(54) FILTER AND PLASMA DISPLAY DEVICE THEREOF

(75) Inventors: Ji Hoon Sohn, Seoul (KR); Hong Rae Cha, Seoul (KR); Sam Je Cho, Seoul (KR); Woo Sung Jang, Seoul (KR); Woon Seo Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 1119 days.

This patent is subject to a terminal disclaimer.

(21) Appl. No.: 12/441,306

(22) PCT Filed: Nov. 6, 2006

(86) PCT No.: PCT/KR2006/004600

§ 371 (c)(1),
(2), (4) Date: Jul. 15, 2009

(87) PCT Pub. No.: WO2008/032894

PCT Pub. Date: Mar. 20, 2008

(65) Prior Publication Data

US 2009/0295686 A1 Dec. 3, 2009

(30) Foreign Application Priority Data

Sep. 14, 2006 (KR) ..... 10-2006-0089169

(51) Int. Cl.
*G09G 3/28* (2013.01)

(52) U.S. Cl.
USPC ..... 345/60; 345/63; 345/64; 313/489; 315/169.4

(58) Field of Classification Search
USPC ..... 345/60–68, 204, 214; 313/110–111, 313/114, 581–587, 489; 315/169.4
See application file for complete search history.

(56) References Cited

U.S. PATENT DOCUMENTS 5,674,553 A 10/1997 Shinoda et al. ..... 427/68
5,939,826 A 8/1999 Ohsawa et al. ..... 313/582

(Continued)

FOREIGN PATENT DOCUMENTS

JP 2001-034183 2/2001
JP 2004-286996 10/2004

(Continued)

OTHER PUBLICATIONS

Office Action dated Jul. 8, 2009 issued in U.S. Appl. No. 11/855,814.

(Continued)

*Primary Examiner* — William Boddie
*Assistant Examiner* — Mansour M Said
(74) *Attorney, Agent, or Firm* — Ked & Associates LLP

(57) ABSTRACT

A plasma display device is provided. The plasma display device includes a plasma display panel (PDP) which includes an upper substrate on which a plurality of black matrices are formed; and an external light shielding sheet which is disposed at a front of the PDP and includes a base unit and a plurality of pattern units that are formed on the base unit and that have a lower refractive index than the base unit. A distance between a pair of adjacent black matrices is 4-12 times greater than a distance between a pair of adjacent pattern units. Therefore, it is possible for a plasma display device to effectively realize black images and enhance bright room contrast with the aid of an external light shielding sheet which is disposed at a front of a PDP and which absorbs and shields as much external light incident upon the PDP as possible. Also, it is possible to reduce the probability of occurrence of the moire phenomenon and enhance the luminance of images displayed by a PDP by forming a plurality of pattern units on an external light shielding sheet so that the distance between the pair of adjacent pattern units can fall within a predetermined percentage range of the distance between the pair of adjacent black matrices formed on a PDP, or that the width of the pattern units can fall within a predetermined percentage range of the width of black matrices formed on the PDP.

34 Claims, 5 Drawing Sheets

(56) References Cited

U.S. PATENT DOCUMENTS

| | | | | |
|---|---|---|---|---|
| 6,580,216 | B1 | 6/2003 | Lu et al. | |
| 6,650,051 | B1 | 11/2003 | Park et al. | 313/582 |
| 6,657,387 | B1 | 12/2003 | Yoo | |
| 6,762,553 | B1 | 7/2004 | Yokogawa et al. | 313/509 |
| 7,235,927 | B2 | 6/2007 | Yoo | 313/586 |
| 7,362,051 | B2 | 4/2008 | Kweon | 313/586 |
| 8,013,807 | B2 * | 9/2011 | Cha et al. | 345/60 |
| 2003/0146688 | A1 | 8/2003 | Kitazawa et al. | 313/491 |
| 2004/0142623 | A1 * | 7/2004 | Joo et al. | 445/24 |
| 2005/0041001 | A1 | 2/2005 | Sumida et al. | 345/60 |
| 2005/0184930 | A1 | 8/2005 | Kim et al. | 345/60 |
| 2005/0190321 | A1 | 9/2005 | Ohsawa | 349/106 |
| 2006/0076879 | A1 | 4/2006 | Kwon | 313/485 |
| 2006/0172119 | A1 | 8/2006 | Hayashi et al. | 428/156 |
| 2006/0250064 | A1 * | 11/2006 | Park et al. | 313/112 |

FOREIGN PATENT DOCUMENTS

| | | | |
|---|---|---|---|
| KR | 10-2000-0067640 | A | 11/2000 |
| KR | 10-2006-0080119 | A1 | 7/2006 |
| KR | 10-2006-0120527 | A | 11/2006 |

OTHER PUBLICATIONS

U.S. Office Action dated Jan. 6, 2011 issued in U.S. Appl. No. 11/855,814.

International Search Report dated Jun. 14, 2007.

* cited by examiner

FILTER AND PLASMA DISPLAY DEVICE THEREOF

TECHNICAL FIELD

The present invention relates to a plasma display panel (PDP), and more particularly, to a plasma display device in which an external light shielding sheet is disposed at the front of a PDP in order to shield external light incident upon the PDP so that the bright room contrast of the PDP can be enhanced while maintaining the luminance of the PDP.

BACKGROUND ART

In general, plasma display panels (PDPs) display images including text and graphic images by applying a predetermined voltage to a number of electrodes installed in a discharge space to cause a gas discharge and then exciting phosphors with the aid of plasma that is generated as a result of the gas discharge. PDPs are easy to manufacture as large-dimension, light, and thin flat displays. In addition, PDPs can provide wide vertical and horizontal viewing angles, full colors and high luminance.

In the meantime, external light incident upon a PDP may be reflected by an entire surface of the PDP due to white phosphors that are exposed on a lower substrate of the PDP. For this reason, PDPs may mistakenly recognize and realize black images as being brighter than they actually are, thereby causing contrast degradation.

DISCLOSURE

Technical Problem

The present invention provides a plasma display device which can prevent light reflection by effectively shielding external light incident upon a plasma display panel (PDP) and which can improve the bright room contrast and luminance of a PDP.

Technical Solution

According to an aspect of the present invention, there is provided a plasma display device, including a plasma display panel (PDP) which includes an upper substrate on which a plurality of black matrices are formed and an external light shielding sheet which is disposed at a front of the PDP and includes a base unit and a plurality of pattern units that are formed on the base unit and that have a lower refractive index than the base unit. A distance between a pair of adjacent black matrices is 4-12 times greater than a distance between a pair of adjacent pattern units.

According to another aspect of the preset invention, there is provided a plasma display device, including a PDP which includes an upper substrate on which a plurality of black matrices are formed and an external light shielding sheet which is disposed at a front of the PDP and includes a base unit and a plurality of pattern units that are formed on the base unit and that have a lower refractive index than the base unit. A distance between a pair of adjacent black matrices is 4-9 times greater than a distance between a pair of adjacent pattern units.

According to another aspect of the preset invention, there is provided a plasma display device, including a PDP which includes an upper substrate on which a plurality of pairs of electrodes and a plurality of black matrices are formed, the black matrices respectively being distant apart from the pairs of electrodes and an external light shielding sheet which is disposed at a front of the PDP and includes a base unit and a plurality of pattern units that are formed on the base unit and that have a lower refractive index than the base unit. A distance between a pair of adjacent black matrices is 7-12 times greater than a distance between a pair of adjacent pattern units.

According to another aspect of the preset invention, there is provided a plasma display device, including a PDP which includes an upper substrate on which a plurality of black matrices are formed and an external light shielding sheet which is disposed at a front of the PDP and includes a base unit and a plurality of pattern units that are formed on the base unit and that have a lower refractive index than the base unit. A width of the black matrices is 3-15 times greater than a width of the pattern units.

According to another aspect of the preset invention, there is provided a plasma display device, including a PDP which includes an upper substrate on which a plurality of pairs of electrodes and a plurality of black matrices are formed, the black matrices respectively overlapping the pairs of electrodes and an external light shielding sheet which is disposed at a front of the PDP and includes a base unit and a plurality of pattern units that are formed on the base unit and that have a lower refractive index than the base unit. A width of the black matrices is 10-15 times greater than a width of the pattern units.

According to another aspect of the preset invention, there is provided a plasma display device, including a PDP which includes an upper substrate on which a plurality of pairs of electrodes and a plurality of black matrices are formed, the black matrices respectively being distant apart from the pairs of electrodes and an external light shielding sheet which is disposed at a front of the PDP and includes a base unit and a plurality of pattern units that are formed on the base unit and that have a lower refractive index than the base unit. A width of the black matrices is 3-7 times greater than a width of the pattern units.

According to another aspect of the preset invention, there is provided a filter that shields external light incident upon a PDP, the filter including an external light shielding sheet which is disposed at a front of the PDP and includes a base unit and a plurality of pattern units that are formed on the base unit and that have a lower refractive index than the base unit. A distance between a pair of adjacent black matrices that are formed on the PDP is 4-12 times greater than a distance between a pair of adjacent pattern units.

According to another aspect of the preset invention, there is provided a filter that shields external light incident upon a PDP, the filter including an external light shielding sheet which is disposed at a front of the PDP and includes a base unit and a plurality of pattern units that are formed on the base unit and that have a lower refractive index than the base unit. A width of black matrices that are formed on the PDP is 3-15 times greater than a width of the pattern units.

Advantageous Effects

The plasma display device according to the present invention includes an external light shielding sheet which is disposed at the front of a plasma display panel (PDP) and which absorbs and shields as much external light incident upon the PDP as possible. Thus, the plasma display device according to the present invention can effectively realize black images and enhance bright room contrast. Since the distance between a pair of adjacent pattern units formed on the external light shielding sheet is within a predetermined percentage range of the distance between the pair of adjacent black matrices formed on the PDP or the width of the pattern units formed on the external light shielding sheet is a predetermined percentage range of the width of black matrices formed on the PDP, it is possible to reduce the probability of occurrence of the moire phenomenon and to enhance the luminance of images displayed by a PDP.

BEST MODE

Figure 1:
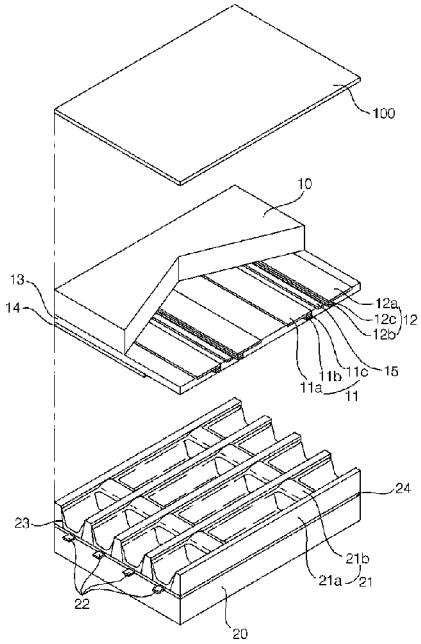
FIG. 1 is a perspective view of a plasma display panel according to an embodiment of the present invention.

The present invention will hereinafter be described more fully with reference to the accompanying drawings, in which exemplary embodiments of the invention are shown. FIG. 1 is a perspective view of a plasma display panel (PDP) according to an embodiment of the present invention.

Referring to FIG. 1, the PDP includes an upper substrate 10, a plurality of electrode pairs which are formed on the upper substrate 10 and consist of a scan electrode 11 and a sustain electrode 12 each, a lower substrate 20, and a plurality of address electrodes 22 which are formed on the lower substrate 20.

Each of the electrode pairs includes transparent electrodes 11*a* and 12*a* and bus electrodes 11*b* and 12*b*. The transparent electrodes 11*a* and 12*a* may be formed of indium-tin-oxide (ITO). The bus electrodes 11*b* and 12*b* may be formed of a metal such as silver (Ag) or chromium (Cr) or may be comprised of a stack of chromium/copper/chromium (Cr/Cu/Cr) or a stack of chromium/aluminium/chromium (Cr/Al/Cr). The bus electrodes 11*b* and 12*b* are respectively formed on the transparent electrodes 11*a* and 12*a* and reduce a voltage drop caused by the transparent electrodes 11*a* and 12*a* which have a high resistance.

According to an embodiment of the present invention, each of the electrode pairs may be comprised of the bus electrodes 11*b* and 12*b* only. In this case, the manufacturing cost of the PDP can be reduced by not using the transparent electrodes 11*a* and 12*a*. The bus electrodes 11*b* and 12*b* may be formed of various materials other than those set forth herein, e.g., a photosensitive material.

Black matrices are formed on the upper substrate 10. The black matrices perform a light shied function by absorbing external light incident upon the upper substrate 10 so that light reflection can be reduced. In addition, the black matrices enhance the purity and contrast of the upper substrate 10.

In detail, the black matrices include a first black matrix 15 which overlaps a plurality of barrier ribs 21, a second black matrix 11*c* which is formed between the transparent electrode 11*a* and the bus electrode 11*b* of each of the scan electrodes 11, and a second black matrix 12*c* which is formed between the transparent electrode 12*a* and the bus electrode 12*b*. The first black matrix 15 and the second black matrices 11*c* and 12*c*, which can also be referred to as black layers or black electrode layers, may be formed at the same time and may be physically connected. Alternatively, the first black matrix 15 and the second black matrices 11*c* and 12*c* may not be formed at the same time, and may not be physically connected.

If the first black matrix 15 and the second black matrices 11*c* and 12*c* are physically connected, the first black matrix 15 and the second black matrices 11*c* and 12*c* may be formed of the same material. On the other hand, if the first black matrix 15 and the second black matrices 11*c* and 12*c* are physically separated, the first black matrix 15 and the second black matrices 11*c* and 12*c* may be formed of different materials.

An upper dielectric layer 13 and a passivation layer 14 are deposited on the upper substrate 10 on which the scan electrodes 11 and the sustain electrodes 12 are formed in parallel with one other. Charged particles generated as a result of a discharge accumulate in the upper dielectric layer 13. The upper dielectric layer 13 may protect the electrode pairs. The passivation layer 14 protects the upper dielectric layer 13 from sputtering of the charged particles and enhances the discharge of secondary electrons.

The address electrodes 22 are formed and intersects the scan electrode 11 and the sustain electrodes 12. A lower dielectric layer 24 and the barrier ribs 21 are formed on the lower substrate 20 on which the address electrodes 22 are formed.

A phosphor layer 23 is formed on the lower dielectric layer 24 and the barrier ribs 21. The barrier ribs 21 include a plurality of vertical barrier ribs 21*a* and a plurality of horizontal barrier ribs 21*b* that form a closed-type barrier rib structure. The barrier ribs 21 define a plurality of discharge cells and prevent ultraviolet (UV) rays and visible rays generated by a discharge from leaking into the discharge cells.

Referring to FIG. 1, a filter 100 is disposed at the front of the PDP. The filter 100 may include an external light shielding sheet, an anti-reflection sheet, a near infrared (NIR) shielding sheet, an electromagnetic interference (EMI) shielding sheet, a diffusion sheet, and an optical sheet.

When the filter 100 is 10-30 μm distant apart from the PDP, the filter 100 can effectively shield external light incident upon the PDP and discharge light generated by the PDP to the outside of the PDP. In order to protect the PDP against external pressure, the distance between the filter 100 and the PDP may be set to 30-120 μm. For shock prevention, an adhesive layer which can absorb shock may be formed between the filter 100 and the PDP.

The present invention can be applied to a barrier rib structure other than that set forth herein. For example, the present invention can be applied to a differential barrier rib structure in which the height of vertical barrier ribs 21*a* is different from the height of horizontal barrier ribs 21*b*, a channel-type barrier rib structure in which a channel that can be used as an exhaust passage is formed in at least one vertical or horizontal barrier rib 21*a* or 21*b*, and a groove-type barrier rib structure in which a groove is formed in at least one vertical or horizontal barrier rib 21*a* or 21*b*. In the differential barrier rib structure, the height of horizontal barrier ribs 21*b* may be greater than the height of vertical barrier ribs 21*a*. In the channel-type barrier rib structure or the groove-type barrier rib structure, a channel or a groove may be formed in at least one horizontal barrier rib 21*b*.

According to the present embodiment, red (R), green (G), and blue (B) discharge cells are arranged in a straight line. However, the present invention is not restricted to this. For example, R, G, and B discharge cells may be arranged as a triangle or a delta. Alternatively, R, G, and B discharge cells may be arranged as a polygon such as a rectangle, a pentagon, or a hexagon.

The phosphor layer 23 is excited by UV rays that are generated upon a gas discharge. As a result, the phosphor layer 23 generates one of R, G, and B rays. A discharge space is provided between the upper and lower substrates 10 and 20 and the barrier ribs 21. A mixture of inert gases, e.g., a mixture of helium (He) and xenon (Xe), a mixture of neon (Ne) and Xe, or a mixture of He, Ne, and Xe is injected into the discharge space.

Figure 2:
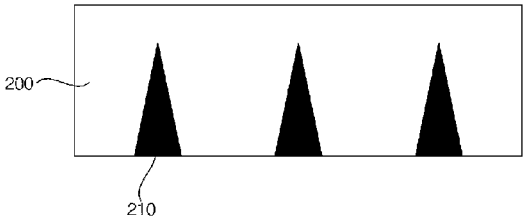
FIG. 2 is a cross-sectional view of an external light shielding sheet that is included in a filter according to an embodiment of the present invention.

FIG. 2 is a cross-section view of an external light shielding sheet that is included in a filter according to an embodiment of the present invention. Referring to FIG. 2, the external light shielding sheet includes a base unit 200 and a plurality of pattern units 210.

The base unit 200 may be formed of a transparent plastic material, e.g., a UV-hardened resin-based material, so that light can smoothly transmit therethrough. Alternatively, the base unit 200 may be formed of a rigid material such as glass in order to enhance the protection of an entire surface of a PDP.

Referring to FIG. 2, the pattern units 210 may be formed as triangles. The pattern units 210 are formed of a darker material than the base unit 200. The pattern units 210 may be formed of a black material. For example, the pattern units 210 may be formed of a carbon-based material or black dye may be applied onto the pattern units 210 so that absorption of external light by the pattern units 210 can be maximized.

Referring to FIG. 2, a position below the external light shielding sheet will hereinafter be referred to as a panel side, and a position above the external light shielding sheet upon which external light is incident will hereinafter be referred to as a user side. Since an external light source is generally located above a PDP, external light is highly likely to be diagonally incident upon a PDP from above. In order to shield external light through light absorption and to enhance the reflection of panel light through total reflection of visible light emitted from a PDP, the refractive index of the patter units 210, particularly, the refractive index of at least the slanted surfaces of the pattern units 210, may be lower than the refractive index of the base unit 200.

Figure 3:
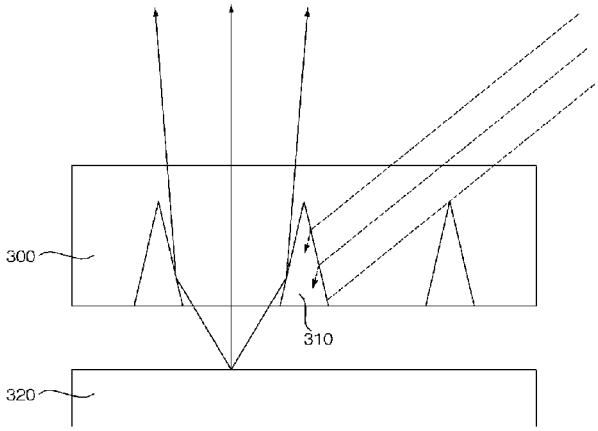
FIG. 3 is a cross-sectional view of an external light shielding sheet according to an embodiment of the present invention and explains an external light shielding function and a panel light reflection function performed by the external light shielding sheet.

FIG. 3 is a cross-sectional view of an external light shielding sheet according to an embodiment of the present invention and explains an external light shielding function and a panel light reflection function performed by the external light shielding sheet.

As described above, external light which reduces the bright room contrast of a PDP is highly likely to be incident upon a PDP from above. Referring to FIG. 3, according to Snell's law, external light that is diagonally incident upon the external light shielding sheet, as indicated by dotted lines, is refracted into and absorbed by a plurality of pattern units 310 which have a lower refractive index than a base unit 300. External light refracted into the pattern units 310 may be absorbed by light absorption particles in the pattern units 310.

Light that is emitted from a PDP 320 for displaying an image, as indicated by solid lines, is totally reflected from the slanted surfaces of the pattern units 310 to the outside of the external light shielding sheet, i.e., toward the user side.

As described above, external light is refracted into and absorbed by the pattern units 310 and light emitted from the PDP 320 is totally reflected by the pattern units 310 because the angle between the external light and each of the slanted surfaces of the pattern units 310 is greater than the angle between the light emitted from the PDP 320 and each of the slanted surfaces of the pattern units 310, as illustrated in FIG. 3.

Therefore, the external light shielding sheet according to the present embodiment can prevent external light incident upon the PDP 320 from being reflected toward the user side by absorbing the external light and can enhance the bright room contrast of an image displayed by the PDP 320 by increasing the reflection of light emitted from the PDP 320.

In order to maximize the absorption of external light and the total reflection of light emitted from the PDP 320 in consideration of the incident angle of external light to the PDP 320, the refractive index of the pattern units 310 may be 0.3-1 times higher than the refractive index of the base unit 300. In order to maximize the total reflection of light emitted from the PDP 320 by the slanted surfaces of the pattern units 310, the refractive index of the pattern units 310 may be set to be 0.3-0.8 times higher than the refractive index of the base unit 300 in consideration of a vertical viewing angle of the PDP 320.

Figure 4:
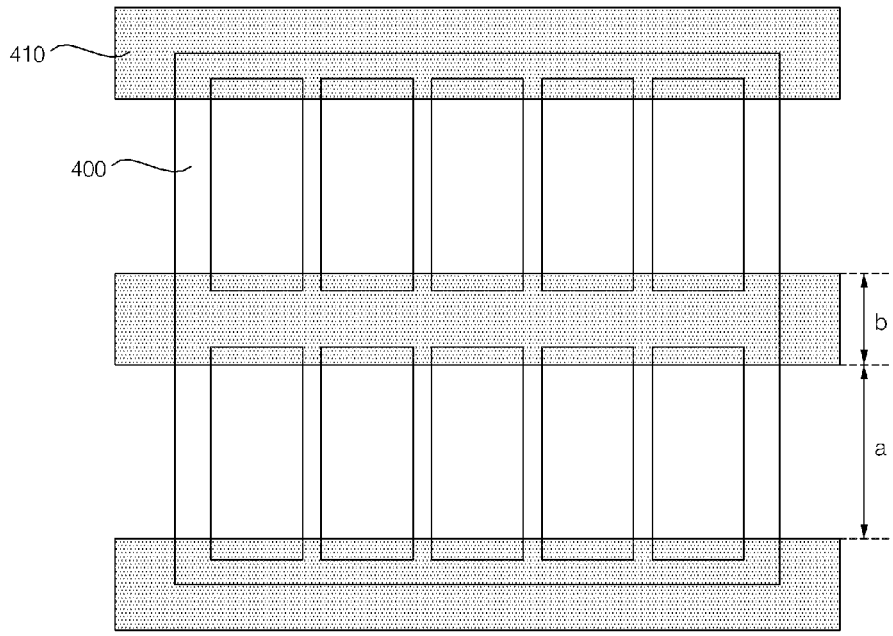
FIGS. 4 and 5 are plan views of black matrices that can be formed on a PDP, according to embodiments of the present invention.
Figure 5:
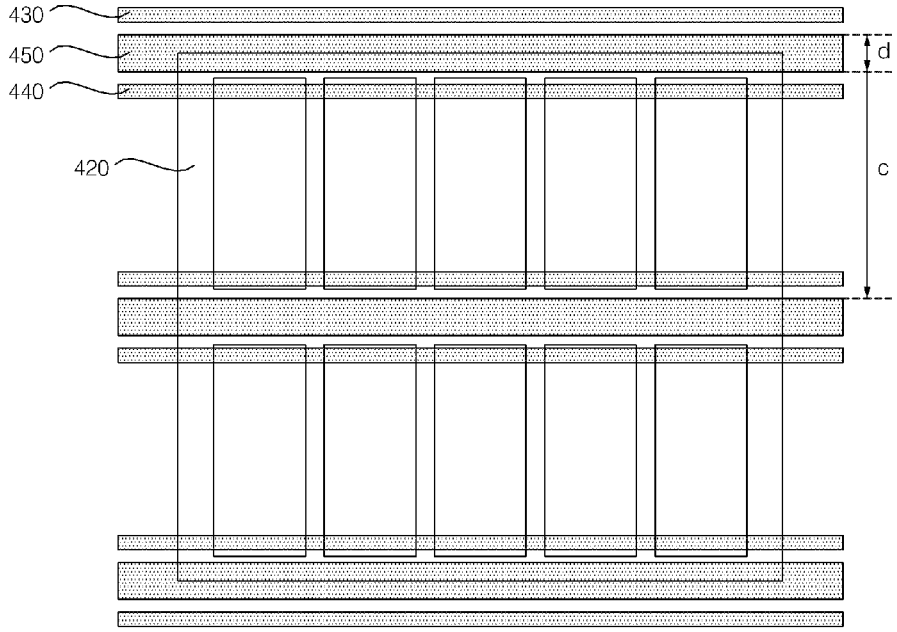

FIGS. 4 and 5 are plan views of black matrices 410 and 450, respectively, which can be formed on a PDP according to an embodiment of the present invention.

Referring to FIG. 4, the black matrices 410 are formed and overlap respective corresponding horizontal barrier ribs that are formed on a lower substrate 400. Also, the black matrices 410 may overlap respective corresponding electrode pairs that are formed on an upper substrate and that include a scan electrode and a sustain electrode each. As a result, the black matrices 410 can hide the respective electrode pairs.

When the width b of the black matrices 410 is 200-400 μm and the distance a between a pair of adjacent black matrices 410 is 300-600 μm, an optimum opening ratio for optimizing the luminance of images displayed by a PDP can be secured, and the efficiency of shielding light by absorbing external light and by reducing the reflection of the external light and the efficiency of enhancing the purity and contrast of an upper substrate can be maximized. Referring to FIG. 5, the black matrices 450 are a predetermined distance apart from respective corresponding electrode pairs, each electrode pair comprising a scan electrode 430 and a sustain electrode 440.

The width d of the black matrices 450 is 70-150 μm and the distance c between a pair of adjacent black matrices 450 is 500-800 μm, the efficiency of shielding light by absorbing external light and by reducing the reflection of the external light and the efficiency of enhancing the purity and contrast of an upper substrate can be maximized.

FIGS. 6 through 11 are cross-sectional views of external light shielding sheets according to embodiments of the present invention. The external light shielding sheet illustrated in FIG. 6 includes a base unit 500 and a plurality of pattern units 510.

Figure 6:
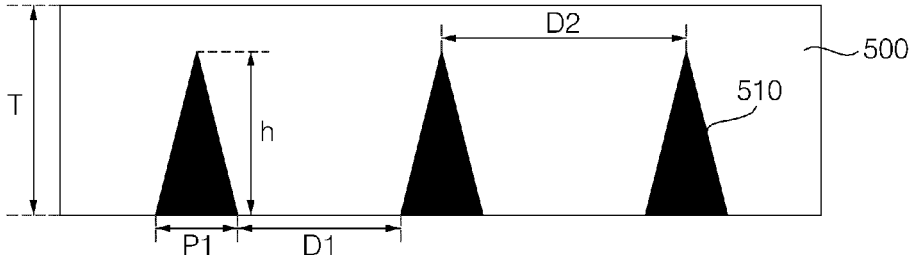
FIGS. 6 through 11 are cross-sectional views of various shapes of pattern units that can be formed in an external light shielding sheet, according to embodiments of the present invention.

Referring to FIG. 6, a position below the external light shielding sheet will hereinafter be referred to as a panel side, and a position above the external light shielding sheet upon which external light is incident will hereinafter be referred to as a user side. Since an external light source is generally located above a PDP, external light is highly likely to be diagonally incident upon a PDP from above.

In order to shield external light through light absorption and to enhance the reflection of panel light through total reflection of visible light emitted from a PDP, the refractive index of the patter units 510, particularly, the refractive index of at least the slanted surfaces of the pattern units 510, may be lower than the refractive index of the base unit 500.

External light which reduces the bright room contrast of a PDP is highly likely to be incident upon a PDP from above. Referring to FIG. 6, according to Snell's law, external light that is diagonally incident upon the external light shielding sheet is refracted into and absorbed by the pattern units 510 which have a lower refractive index than the base unit 500. External light refracted into the pattern units 510 may be absorbed by light absorption particles in the pattern units 510.

Light that is emitted from a PDP for displaying an image is totally reflected from the slanted surfaces of the pattern units 510 to the outside of the external light shielding sheet, i.e., toward the user side.

As described above, external light is refracted into and absorbed by the pattern units 510 and light emitted from a PDP is totally reflected by the pattern units 510 because the angle between the external light and each of the slanted surfaces of the pattern units 510 is greater than the angle between the light emitted from the PDP and each of the slanted surfaces of the pattern units 510, as illustrated in FIG. 6.

Therefore, the external light shielding sheet according to the present embodiment can prevent external light incident upon a PDP from being reflected toward the user side by absorbing the external light and can enhance the bright room contrast of an image displayed by the PDP by increasing the reflection of light emitted from the PDP.

In order to maximize the absorption of external light and the total reflection of light emitted from a PDP in consideration of the incident angle of external light to the PDP, the refractive index of the pattern units 510 may be 0.3-1 times higher than the refractive index of the base unit 500. In order to maximize the total reflection of light emitted from a PDP by the slanted surfaces of the pattern units 510, the refractive index of the pattern units 510 may be set to be 0.3-0.8 times higher than the refractive index of the base unit 500 in consideration of a vertical viewing angle of the PDP.

The base unit 500 may be formed of a transparent plastic material, e.g., a UV-hardened resin-based material, so that light can smoothly transmit therethrough. Alternatively, the base unit 500 may be formed of a rigid material such as glass in order to enhance the protection of an entire surface of a PDP.

Referring to FIG. 6, the pattern units 510 may be formed as triangles. The pattern units 510 are formed of a darker material than the base unit 500. The pattern units 510 may be formed of a black material. For example, the pattern units 510 may be formed of a carbon-based material or black dye may be applied onto the pattern units 510, thereby maximizing absorption of external light by the pattern units 510.

In order to facilitate the manufacture of light absorption particles and the insertion of the light absorption particles into the pattern units 510 and to maximize the absorption of external light, the light absorption particles may be formed to have a size of 1 μm or more. In order to effectively absorb external light refracted into the pattern units 510, the pattern units 510 may contain at least 10 weight % of light absorption particles having a size of 1 μm or more. In this case, the total weight of light absorption particles contained in the pattern units 510 may account for at least 10% of the total weight of the pattern units 510.

When the thickness T of the external light shielding sheet is 20-250 μm, the manufacture of the external light shielding sheet can be facilitated and the transmissivity of the external light shielding sheet can be optimized. The thickness T may be set to 100-180 μm in order to effectively absorb and shield external light refracted into the pattern units 510 and to enhance the durability of the external light shielding sheet.

Referring to FIG. 6, the pattern units 510 may be formed as triangles, and particularly, as equilateral triangles. The bottom width P1 may be 18-35 μm. In this case, light emitted from a PDP can be smoothly discharged toward the user side. Thus, it is possible to guarantee an optimum opening ratio and maximize external light shielding efficiency.

The height h of the pattern units 510 is set to 80-170 μm in consideration of the bottom width P1. Thus, the pattern units 510 can form a gradient that can effectively absorb external light and reflect light emitted from a PDP. In addition, the pattern units 510 can be prevented from being short-circuited.

In order to achieve a sufficient opening ratio to display images with optimum luminance through discharge of light emitted from a PDP toward the user side and to provide an optimum gradient for the pattern units 510 for enhancing the external light shielding efficiency and the reflection efficiency of an external light shielding sheet, the distance D1 between the bottoms of a pair of adjacent pattern units 510 may be set to 40-90 μm, and the distance D2 between the tops of the pair of adjacent pattern units 510 may be set to 60-130 μm. An optimum opening ratio for displaying images can be obtained when the distance D1 is 1.1-5 times greater than the bottom width P1. In order to obtain an optimum opening ratio and to optimize the external light shielding efficiency and the reflection efficiency of an external light shielding sheet, the distance D1 may be set to be 1.5-3.5 greater than the bottom width P1.

When the height h is 0.89-4.25 times greater than the distance D1, external light that is diagonally incident upon the external light shielding sheet from above can be prevented from being incident upon a PDP. In order to prevent the pattern units 510 from being short-circuited and to optimize the reflection of light emitted from a PDP, the height h may be set to be 1.5-3 times greater than the distance D1.

When the distance D2 is 1-3.25 times greater than the distance D1, a sufficient opening ratio to display images with optimum luminance can be obtained. In order to maximize the total reflection of light emitted from a PDP by the slanted surfaces of the pattern units 510, the distance D2 may be set to be 1.2-2.5 times greater than the distance D1.

Figure 7:
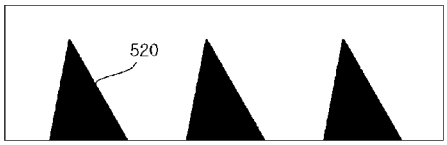

Referring to FIG. 7, each of a plurality of pattern units 520 may be horizontally asymmetrical. In other words, a pair of slanted surfaces of each of the pattern units 520 may have different areas or may form different angles with the bottom of a corresponding pattern unit 520. In general, an external light source is located above a PDP. Thus, external light is highly likely to be incident upon a PDP from above at various angles within a predetermined range. One of a pair of slanted surfaces of each of the pattern units 510 upon which external light is directly incident will hereinafter be referred to as an upper slanted surface, and the other slanted surface will hereinafter be referred to as a lower slanted surface. In order to enhance the absorption of external light and the reflection of light emitted from a PDP, the upper slanted surfaces of the pattern units 510 may be less steep than the lower slanted surfaces of the pattern units 510. That is, the slope of the upper slanted surfaces of the pattern units 510 may be less than the slope of the lower slanted surface of the pattern units 510.

Figure 8:
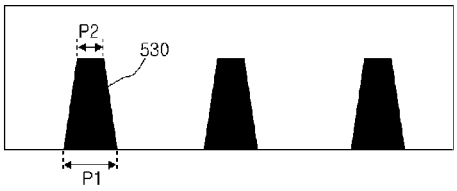

Referring to FIG. 8, a plurality of pattern units 530 may be trapezoidal. In this case, the top width P2 of the pattern units 530 is less than the bottom width P1 of the pattern units 530. The top width P2 may be 10 μm or less. The slope of the slanted surfaces of the pattern units 530 can be appropriately determined according to the relationship between the bottom width P1 and the top width P2 so that the absorption of external light and the reflection of light emitted from a PDP can be maximized.

Figure 9:
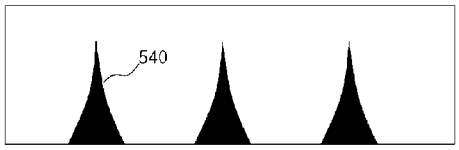
Figure 10:
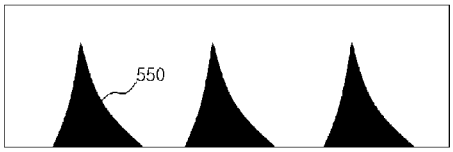
Figure 11:
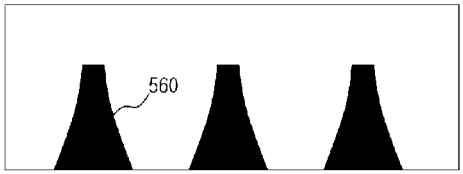

Referring to FIGS. 9 through 11, a pair of slanted surfaces of each of a plurality of pattern units 540, 550, or 560 may have a curved profile. Also, the top or bottom surface of each of the pattern units 540, 550, and 560 may have a curved profile.

Referring to FIGS. 6 through 11, each of the pattern units 510, 520, 530, 540, 550, or 560 may have curved edges having a predetermined curvature. In particular, the pattern units 510, 520, 530, 540, 550, or 560 may have outwardly extending, curved lower edges.

Figure 12:
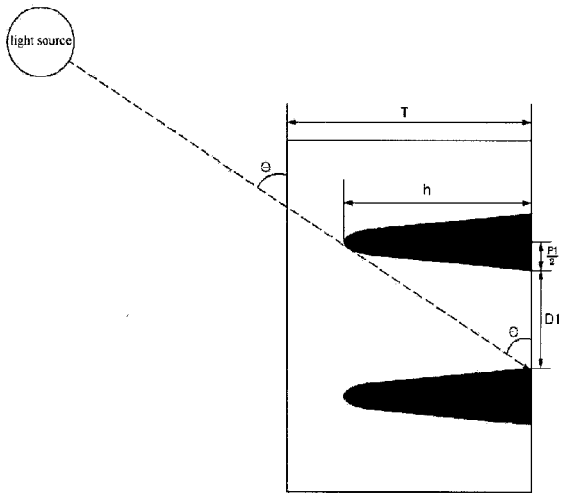
FIG. 12 is a cross-sectional view for explaining the relationship between the thickness of an external light shielding sheet and the height of pattern units of the external light shielding sheet.

FIG. 12 is a cross-sectional view of an external light shielding sheet according to an embodiment of the present invention and explains the relationship between the thickness T of the external light shielding sheet and the height h of pattern units.

Referring to FIG. 12, in order to enhance the durability of an external light shielding sheet comprising a plurality of pattern units and secure the transmission of visible light emitted from a PDP for displaying images, the thickness T may be set to 100-180 μm.

When the height h is within the range of 80-170 μm, the manufacture of an external light shielding sheet can be facilitated, an optimum opening ratio can be obtained, and the shielding of external light and the reflection of light emitted from a PDP can be maximized.

The height h can be varied according to the thickness T. In general, external light that considerably affects the bright room contrast of a PDP is highly likely to be incident upon a PDP from above. Therefore, in order to effectively shield external light, the height h may be within a predetermined percentage range of the thickness T.

Referring to FIG. 12, as the height h increases, the thickness of a base unit decreases, and thus, dielectric breakdown is more likely to occur. On the other hand, as the height h decreases, more external light is likely to be incident upon a PDP at various angles within a predetermined range, and thus it becomes more difficult for an external light shielding sheet to properly shield such external light.

Table 1 presents experimental results obtained by testing a plurality of external light shielding sheets having the same thickness T and different pattern unit heights (h) for whether they cause dielectric breakdown and whether they can shield external light.

TABLE 1

| Thickness (T) of External Light | Height (h) of Pattern Units | Dielectric Breakdown | External Light Shielding |
|---|---|---|---|
| 120 μm | 120 μm | ○ | ○ |
| 120 μm | 115 μm | Δ | ○ |
| 120 μm | 110 μm | x | ○ |
| 120 μm | 105 μm | x | ○ |
| 120 μm | 100 μm | x | ○ |
| 120 μm | 95 μm | x | ○ |
| 120 μm | 90 μm | x | ○ |
| 120 μm | 85 μm | x | Δ |
| 120 μm | 80 μm | x | Δ |
| 120 μm | 75 μm | x | Δ |
| 120 μm | 70 μm | x | Δ |
| 120 μm | 65 μm | x | Δ |
| 120 μm | 60 μm | x | Δ |

TABLE 1-continued

| Thickness (T) of External Light | Height (h) of Pattern Units | Dielectric Breakdown | External Light Shielding |
|---|---|---|---|
| 120 μm | 55 μm | x | Δ |
| 120 μm | 50 μm | x | x |

Referring to Table 1, when the thickness T is 120 μm and the height h is greater than 115 μm, pattern units in the external light shielding sheet are highly likely to dielectrically break down, thereby increasing defect rates. When the height h is less than 115 μm, the pattern units are less likely to dielectrically break down, thereby reducing defect rates. When the height h is less than 85 μm, the external light shielding efficiency of the pattern units is likely to decrease. When the height h is less than 60 μm, external light is likely to be directly incident upon a PDP.

When the thickness T is 1.01-2.25 times greater than the height h, it is possible to prevent the upper portions of the pattern units from dielectrically breaking down and to prevent external light from being incident upon a PDP. In order to prevent dielectric breakdown of the pattern units and infiltration of external light into a PDP, to increase the reflection of light emitted from a PDP, and to secure optimum viewing angles, the thickness T may be 1.01-1.5 times greater than the height h.

Table 2 presents experimental results obtained by testing a plurality of external light shielding sheets having different pattern unit bottom width-to-bus electrode width ratios for whether they cause the moire phenomenon and whether they can shield external light, when the width of bus electrodes that are formed on an upper substrate of a PDP is 90 μm.

TABLE 2

| Bottom Width of Pattern Units/Width of Bus Electrodes | Moire | External light shielding |
|---|---|---|
| 0.10 | Δ | x |
| 0.15 | Δ | x |
| 0.20 | x | Δ |
| 0.25 | x | ○ |
| 0.30 | x | ○ |
| 0.35 | x | ○ |
| 0.40 | x | ○ |
| 0.45 | Δ | ○ |
| 0.50 | Δ | ○ |
| 0.55 | ○ | ○ |
| 0.60 | ○ | ○ |

Referring to Table 2, when the bottom width P1 of pattern units is 0.2-0.5 times greater than the bus electrode width, the moire phenomenon can be prevented and the amount of external light incident upon a PDP can be reduced. In order to prevent the moire phenomenon, to effectively shield external light, and to secure a sufficient opening ratio to discharge light emitted from a PDP, the bottom width P1 may be 0.25-0.4 times greater than the bus electrode width.

Table 3 presents experimental results obtained by testing a plurality of external light shielding sheets having different pattern unit bottom width-to-vertical barrier rib width ratios for whether they cause the moire phenomenon and whether they can shield external light, when the width of vertical barrier ribs that are formed on a lower substrate of a PDP is 50 μm.

TABLE 3

| Bottom Width of Pattern Units/Top Width of Vertical Barrier Ribs | Moire | External Light shielding |
|---|---|---|
| 0.10 | ○ | x |
| 0.15 | Δ | x |
| 0.20 | Δ | x |
| 0.25 | Δ | x |
| 0.30 | x | Δ |
| 0.35 | x | Δ |
| 0.40 | x | ○ |
| 0.45 | x | ○ |
| 0.50 | x | ○ |
| 0.55 | x | ○ |
| 0.60 | x | ○ |
| 0.65 | x | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 3, when the bottom width P1 is 0.3 0.8 times greater than the vertical barrier rib width, the moire phenomenon can be prevented and the amount of external light incident upon a PDP can be reduced. In order to prevent the moire phenomenon, to effectively shield external light, and to secure a sufficient opening ratio to discharge light emitted from a PDP, the bottom width P1 may be 0.4 0.65 times greater than the vertical barrier rib width.

FIGS. 13 through 16 are cross-sectional views of filters according to embodiments of the present invention, each filter including a plurality of sheets. A filter, which is disposed at the front of a PDP, may include an AR/NIR sheet, an EMI shielding sheet 1020, an external light shielding sheet 1030, and an optical sheet.

Figure 13:
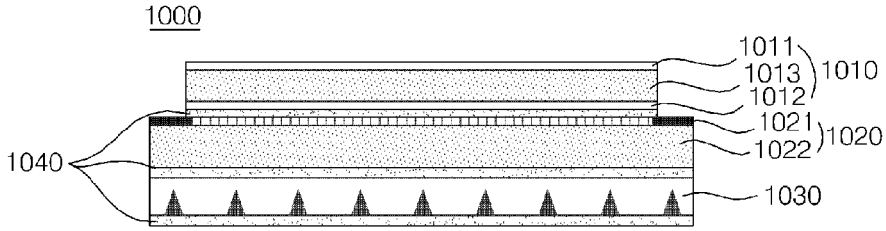
FIGS. 13 through 16 are cross-sectional views of filters according to embodiments of the present invention, each filter including a plurality of sheets.
Figure 14:
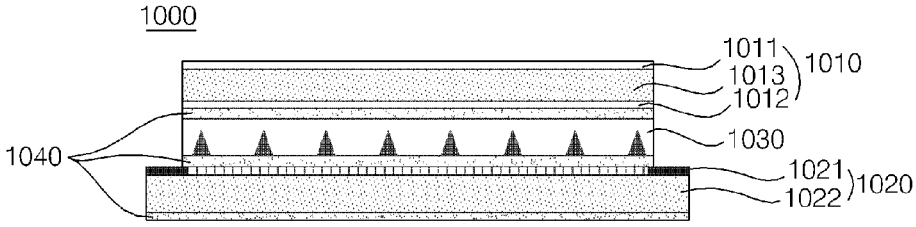

Referring to FIGS. 13 and 14, a filter 1000 includes an AR/NIR sheet 1010, an EMI shielding sheet 1020, and an external light shielding sheet 1030. The AR/NIR sheet 1010 includes a base sheet 1013 which is formed of a transparent plastic material, an AR layer 1011 which is attached onto an entire surface of the base sheet 1013 and reduces glare by preventing the reflection of external light incident upon a PDP, and an NIR shielding layer 1012 which is attached onto a rear surface of the base sheet 1013 and shields NIR rays emitted from a PDP so that signals provided by a device such as a remote control which transmits signals using infrared rays can be smoothly transmitted.

The EMI shielding sheet 1020 includes a base sheet 1022 which is formed of a transparent plastic material and an EMI shielding layer 1021 which is attached onto an entire surface of the base sheet 1022 and shields EMI generated by a PDP so that the EMI can be prevented from being released externally. The EMI shield layer 1021 may be formed of a conductive material in a mesh form. In order to properly ground the EMI shielding layer 1021, an invalid display zone on the EMI shielding sheet 1020 where no images are displayed is covered with a conductive material.

An external light source is generally located over the head of a user regardless of an indoor or outdoor environment. The external light shielding sheet 1030 effectively shields external light so that black images can be rendered even blacker by a PDP.

An adhesive layer 1040 is interposed between the AR/NIR sheet 1010, the EMI shielding sheet 1020, and the external light shielding sheet 1030 so that the filter 1000 including the AR/NIR sheet 1010, the EMI shielding sheet 1020, and the external light shielding sheet 1030 can be firmly attached onto a PDP. In order to facilitate the manufacture of the filter 1000, the base sheets 1013 and 1022 may be formed of the same material.

Referring to FIG. 13, the AR/NIR sheet 1010, the EMI shielding sheet 1020, and the external light shielding sheet 1030 are sequentially deposited. Alternatively, the AR/NIR sheet 1010, the external light shielding sheet 1030, and the EMI shielding sheet 1020 may be sequentially deposited, as illustrated in FIG. 13. The order in which the AR/NIR sheet 1010, the EMI shielding sheet 1020, and the external light shielding sheet 1030 are deposited is not restricted to those set forth herein. At least one of the AR/NIR sheet 1010, the EMI shielding sheet 1020, and the external light shielding sheet 1030 may not be formed.

Figure 15:
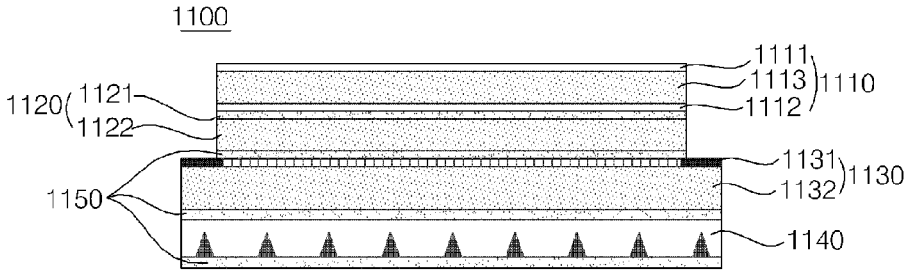
Figure 16:
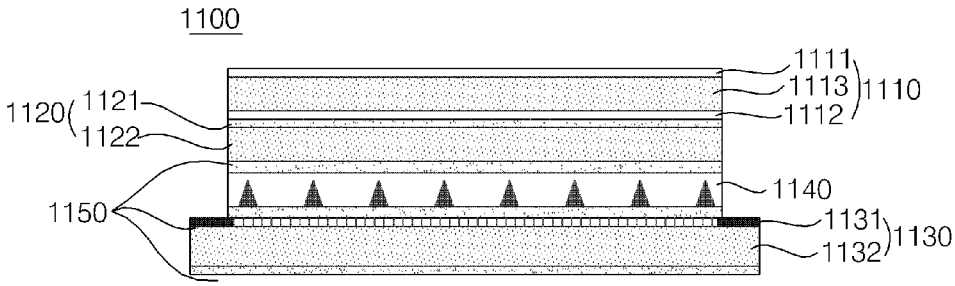

Referring to FIGS. 15 and 16, a filter 1100, which is disposed at the front of a PDP, includes an AR/NIR sheet 1110, an EMI shielding sheet 1130, an external light shielding sheet 1140, and an optical sheet 1120. The AR/NIR sheet 1110, the EMI shielding sheet 1130, and the external light shielding sheet 1140 are the same as their respective counterparts illustrated in FIGS. 12 and 13. The optical sheet 1120 enhances the color temperature and luminance properties of light incident upon a PDP from above. The optical sheet 1120 includes a base sheet 1122 which is formed of a transparent plastic material, and an optical sheet layer 1121 which is formed of a dye and an adhesive on a front or rear surface of the base sheet 1122.

At least one of the base sheets 1013 and 1022 illustrated in FIGS. 12 and 13 and at least one of a base sheet 1113, a base sheet 1112, and the base sheet 1122 illustrated in FIGS. 15 and 16 may not be formed. One of the base sheets 1013 and 1022 illustrated in FIGS. 13 and 14 and one of the base sheets 1113, 1112, and 1122 illustrated in FIGS. 15 and 16 may be formed of such a rigid material as glass, instead of being formed of a plastic material, so that the protection of a PDP can be enhanced. Whichever of the base sheets 1013 and 1022 illustrated in FIGS. 13 and 14 and the base sheets 1113, 1112, and 1122 illustrated in FIGS. 15 and 16 is formed of glass may be a predetermined distance apart from a PDP.

A filter according to an embodiment of the present invention may also include a diffusion sheet. The diffusion sheet can diffuse light incident upon a PDP so that the brightness of the PDP can be uniformly maintained. In addition, the diffusion sheet can widen vertical and horizontal viewing angles of a display screen by uniformly diffusing light emitted from a PDP. Moreover, the diffusion sheet can hide patterns formed on an external light shielding sheet. Furthermore, the diffusion sheet can uniformly enhance the front luminance of a PDP through collection of light in a direction corresponding to a vertical viewing angle, and can enhance the antistatic property of a PDP.

The diffusion sheet may be comprised of a transparent or reflective diffusion film. In general, the diffusion sheet may be comprised of a polymer base sheet containing small glass particles. The diffusion sheet may also be comprised of a polymethyl-methacrylate (PMMA) base sheet. In this case, the diffusion sheet is thick and highly heat-resistant and can thus be applied to large-scale display devices which generate a considerable amount of heat.

INDUSTRIAL APPLICABILITY

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A plasma display device, comprising:

a plasma display panel (PDP) which includes an upper substrate on which a plurality of black matrices are formed; and an external light shielding sheet which is disposed at a front of the PDP and includes a base unit and a plurality of pattern units that are formed on the base unit and that have a lower refractive index than the base unit, wherein a distance between a pair of adjacent black matrices is 4-12 times greater than a distance between a pair of adjacent pattern units, wherein a height of the plurality of pattern units is greater than the distance between the pair of adjacent pattern units, and wherein a thickness of the external light shielding sheet is 1.01-1.5 times greater than the height of the plurality of pattern units.

2. The plasma display device of claim 1, wherein the refractive index of the pattern units is 0.3-1 times higher than the refractive index of the base unit.

3. The plasma display device of claim 1, wherein the height of the pattern units is greater than a height of the black matrices.

4. The plasma display device of claim 1, wherein a bottom width of the pattern units is 18-35 μm.

5. The plasma display device of claim 1 further comprising a plurality of electrode pairs formed on the upper substrate, the plurality of electrode pairs includes transparent electrodes and bus electrodes, and a bottom width of the pattern units is 0.2-0.5 times greater than a width of the bus electrode.

6. The plasma display device of claim 1 further comprising a lower substrate on which barrier ribs are formed, the barrier ribs includes a plurality of vertical barrier ribs and a plurality of horizontal barrier ribs, and a bottom width of the pattern units is 0.3-0.8 times greater than a bottom width of the vertical barrier rib.

7. The plasma display device of claim 1, wherein the thickness of the external light shielding sheet is 100-180 μm.

8. The plasma display device of claim 1, wherein the distance between the pair of adjacent pattern units is 2.5-5 times greater than a bottom width of the pattern units.

9. The plasma display device of claim 1, wherein the height of the plurality of pattern units is 1.1-5 times greater than the distance between the pair of adjacent pattern units.

10. The plasma display device of claim 1, further comprising:

an anti-reflection (AR) layer which prevents reflection of external light;

a near infrared (NIR) shielding layer which shields NIR rays emitted from the PDP; and an electromagnetic interference (EMI) shielding layer which shields EMI.

11. A plasma display device, comprising:

a PDP which includes an upper substrate on which a plurality of black matrices are formed; and an external light shielding sheet which is disposed at a front of the PDP and includes a base unit and a plurality of pattern units that are formed on the base unit and that have a lower refractive index than the base unit, wherein a distance between a pair of adjacent black matrices is 4-9 times greater than a distance between a pair of adjacent pattern units, wherein a height of the plurality of pattern units is greater than the distance between the pair of adjacent pattern units, and wherein a thickness of the external light shielding sheet is 1.01-1.5 times greater than the height of the plurality of pattern units.

12. The plasma display device of claim 11, wherein the distance between the pair of adjacent black matrices is 300-600 μm.

13. A plasma display device, comprising:

a PDP which includes an upper substrate on which a plurality of pairs of electrodes and a plurality of black matrices are formed, the black matrices respectively being distant apart from the pairs of electrodes; and an external light shielding sheet which is disposed at a front of the PDP and includes a base unit and a plurality of pattern units that are formed on the base unit and that have a lower refractive index than the base unit, wherein a distance between a pair of adjacent black matrices is 7-12 times greater than a distance between a pair of adjacent pattern units, wherein a height of the plurality of pattern units is greater than the distance between the pair of adjacent pattern units, and wherein a thickness of the external light shielding sheet is 1.01-1.5 times greater than the height of the plurality of pattern units.

14. The plasma display device of claim 13, wherein the distance between the pair of adjacent black matrices is 300-800 μm.

15. A plasma display device, comprising:

a PDP which includes an upper substrate on which a plurality of black matrices are formed; and an external light shielding sheet which is disposed at a front of the PDP and includes a base unit and a plurality of pattern units that are formed on the base unit and that have a lower refractive index than the base unit, wherein a width of the black matrices is 3-15 times greater than a bottom width of the pattern units, wherein a height of the plurality of pattern units is greater than a distance between a pair of adjacent pattern units, and wherein a thickness of the external light shielding sheet is 1.01-1.5 times greater than the height of the plurality of pattern units.

16. The plasma display device of claim 15, wherein the refractive index of the pattern units is 0.3-1 times higher than the refractive index of the base unit.

17. The plasma display device of claim 15, wherein the width of the black matrices is 70-400 μm.

18. The plasma display device of claim 15, wherein the bottom width of the pattern units is 18-35 μm.

19. The plasma display device of claim 15 further comprising a plurality of electrode pairs formed on the upper substrate, the plurality of electrode pairs includes transparent electrodes and bus electrodes, and the bottom width of the pattern units is 0.2-0.5 times greater than a width of the bus electrode.

20. The plasma display device of claim 15, wherein the distance between the pair of adjacent pattern units is 1.1-5 times greater than a bottom width of the pattern units.

21. The plasma display device of claim 15 further comprising a lower substrate on which barrier ribs are formed, the barrier ribs includes a plurality of vertical barrier ribs and a plurality of horizontal barrier ribs, and a bottom width of the pattern units is 0.3-0.8 times greater than a bottom width of the vertical barrier rib.

22. The plasma display device of claim 15, further comprising:

an AR layer which prevents reflection of external light;

an NIR shielding layer which shields NIR rays emitted from the PDP; and an EMI shielding layer which shields EMI.

23. A plasma display device, comprising:

a PDP which includes an upper substrate on which a plurality of pairs of electrodes and a plurality of black matrices are formed, the black matrices respectively overlapping the pairs of electrodes; and an external light shielding sheet which is disposed at a front of the PDP and includes a base unit and a plurality of pattern units that are formed on the base unit and that have a lower refractive index than the base unit, wherein a width of the black matrices is 10-15 times greater than a bottom width of the pattern units, wherein a height of the plurality of pattern units is greater than a distance between a pair of adjacent pattern units, and wherein a thickness of the external light shielding sheet is 1.01-1.5 times greater than the height of the plurality of pattern units.

24. The plasma display device of claim 23, wherein the width of the black matrices is 200-400 μm.

25. A plasma display device, comprising:

a PDP which includes an upper substrate on which a plurality of pairs of electrodes and a plurality of black matrices are formed, the black matrices respectively being distant apart from the pairs of electrodes; and an external light shielding sheet which is disposed at a front of the PDP and includes a base unit and a plurality of pattern units that are formed on the base unit and that have a lower refractive index than the base unit, wherein a width of the black matrices is 3-7 times greater than a bottom width of the pattern units, wherein a height of the plurality of pattern units is greater than a distance between a pair of adjacent pattern units, and wherein a thickness of the external light shielding sheet is 1.01-1.5 times greater than the height of the plurality of pattern units.

26. The plasma display device of claim 25, wherein the width of the black matrices is 200-400 μm.

27. A filter that shields external light incident upon a PDP, the filter comprising:

an external light shielding sheet which is disposed at a front of the PDP and includes a base unit and a plurality of pattern units that are formed on the base unit and that have a lower refractive index than the base unit, wherein a distance between a pair of adjacent black matrices that are formed on the PDP is 4-12 times greater than a distance between a pair of adjacent pattern units, wherein a height of the plurality of pattern units is greater than the distance between the pair of adjacent pattern units, and wherein a thickness of the external light shielding sheet is 1.01-1.5 times greater than the height of the plurality of pattern units.

28. The filter of claim 27, wherein the refractive index of the pattern units is 0.3-1 times higher than the refractive index of the base unit.

29. The filter of claim 27, wherein the PDP includes an upper substrate and a plurality of electrodes pairs formed on the upper substrate, the plurality of electrode pairs including transparent electrodes and bus electrodes, and wherein a bottom width of the pattern units is 0.2-0.5 times greater than a width of the bus electrode.

30. The filter of claim 27, wherein the PDP further includes a lower substrate on which barrier ribs are formed, the barrier ribs including a plurality of vertical barrier ribs and a plurality of horizontal barrier ribs, and wherein a bottom width of the pattern units is 0.3-0.8 times greater than a bottom width of the vertical barrier rib.

31. A filter that shields external light incident upon a PDP, the filter comprising:

an external light shielding sheet which is disposed at a front of the PDP and includes a base unit and a plurality of pattern units that are formed on the base unit and that have a lower refractive index than the base unit, wherein a width of black matrices that are formed on the PDP is 3-15 times greater than a bottom width of the pattern units, wherein a height of the plurality of pattern units is greater than a distance between a pair of adjacent pattern units, and wherein a thickness of the external light shielding sheet is 1.01-1.5 times greater than the height of the plurality of pattern units.

32. The filter of claim 31, wherein the refractive index of the pattern units is 0.3-1 times higher than the refractive index of the base unit.

33. The filter of claim 31, wherein the width of the black matrices is 70-400 μm.

34. The filter of claim 31, wherein the bottom width of the pattern units is 18-35 μm.

* * * * *